US007005063B2

(12) United States Patent
Hodak

(10) Patent No.: US 7,005,063 B2
(45) Date of Patent: Feb. 28, 2006

(54) FLOW DIVERTING WEIR FOR A SWIMMING POOL SKIMMER HAVING INCREASED FIELD OF INFLUENCE

(76) Inventor: Michael L. Hodak, 326 Double Tree Dr., Venetia, PA (US) 15367

( * ) Notice: Subject to any disclaimer, the term of this patent is extended or adjusted under 35 U.S.C. 154(b) by 4 days.

(21) Appl. No.: 10/768,992

(22) Filed: Jan. 30, 2004

(65) Prior Publication Data

US 2004/0238425 A1 Dec. 2, 2004

Related U.S. Application Data

(60) Provisional application No. 60/444,007, filed on Jan. 31, 2003.

(51) Int. Cl.
*E04H 4/16* (2006.01)

(52) U.S. Cl. ..... 210/169; 210/232; 210/416.2; 4/496

(58) Field of Classification Search ..... 210/169, 210/232, 416.1, 416.2; 4/496
See application file for complete search history.

(56) References Cited

U.S. PATENT DOCUMENTS

| | | | | |
|---|---|---|---|---|
| 4,068,327 | A * | 1/1978 | Heinlein | 210/169 |
| 4,913,810 | A * | 4/1990 | Hodak | 210/169 |
| 5,285,538 | A * | 2/1994 | Hodak | 4/507 |
| 5,490,923 | A * | 2/1996 | Penney | 210/169 |
| 5,510,020 | A * | 4/1996 | Gronlund | 210/169 |
| 5,753,113 | A * | 5/1998 | Hendricks | 210/169 |
| 5,948,245 | A * | 9/1999 | Hodak | 210/169 |
| 6,214,217 | B1 * | 4/2001 | Sliger, Jr. | 210/169 |
| 6,770,193 | B1 * | 8/2004 | Foley | 210/169 |

* cited by examiner

*Primary Examiner*—Fred G. Prince
(74) *Attorney, Agent, or Firm*—The Webb Law Firm

(57) ABSTRACT

A flow diverting weir for attachment to a face plate of a skimmer of a swimming pool comprising an enclosed scoop member having an opening on one side to allow entry of water from the pool into the skimmer, the scoop member further includes a lower peripheral edge which carries flexible lip means for attachment to the skimmer face plate, the scoop member further includes a top surface carrying slot means and an elongated paddle removably received in the slot means, said paddle adapted to extend outwardly into the pool to divert an additional surface flow of pool water into the scoop member and skimmer.

2 Claims, 6 Drawing Sheets

FLOW DIVERTING WEIR FOR A SWIMMING POOL SKIMMER HAVING INCREASED FIELD OF INFLUENCE

CROSS-REFERENCE TO RELATED APPLICATION

This application claims the benefit of U.S. Provisional Application No. 60/444,007 filed Jan. 31, 2003.

BACKGROUND OF THE INVENTION

1. Field of the Invention

The present invention relates generally to swimming pool accessories and, more particularly, to a skimmer weir for both in-ground and aboveground swimming pools. The improved skimmer weir of the present invention increases the area or field of influence of water directed into the skimmer for removing surface debris and contaminants from the pool.

2. Description of Related Art

Swimming pools commonly have one or more skimmers placed in the sidewall thereof at water level to permit the removal of floating debris and other contaminants which float on the surface of the pool. The conventional skimmer has a strainer basket within its body to collect larger objects, such as leaves, insects, and the like, while the balance of the water passes through the strainer basket and travels to a pump/filtration unit by appropriate piping where the finer contaminants and particulates are removed in the filtration unit. Filtered water is then returned to the pool in a conventional manner with appropriate pipes. Periodic additions of chemicals are also made, such as chlorine, to maintain proper biological and pH levels in the pool water.

The opening in a conventional skimmer is substantially coplanar with the pool sidewall and draws surface water into the skimmer body, mainly as a function of the power of the pump motor. In order to increase the efficiency of surface cleaning and to remove floating objects and contaminants, such as suntan oil, which tends to float and accumulate around the pool wall perimeter, it is common practice to direct the inlet water nozzles in an angular direction relative to the pool sidewall to create one of a clockwise or counterclockwise water flow current around the pool. This type of flow pattern tends to sweep debris from the pool sidewalls and minimizes the debris accumulation problem.

Unfortunately, when a clockwise or counterclockwise flow pattern is created in the pool, the conventional skimmer opening is capable of capturing only a small percentage of debris floating immediately adjacent to the sidewall. The debris beyond the capture zone of the skimmer opening usually floats past the skimmer and must make one or more additional circuits around the pool prior to being captured by the skimmer. Debris floating in the central areas of the pool generally will not reach the skimmer for a considerable amount of time. In my prior patented invention covered by U.S. Pat. No. 5,948,245 entitled "Flow Diverting Weir for a Swimming Pool Skimmer," which is incorporated in its entirety by reference herein, I proposed a skimmer attachment which increases the ability of the skimmer to capture debris traveling past the skimmer at a distance far greater than therebefore thought possible. The improved skimmer attachment of that invention comprised a weir which snapped onto a specially-made skimmer face plate disclosed in U.S. Pat. No. 5,285,538 or U.S. Pat. No. 5,937,453 to Frank and Michael Hodak which are, likewise, incorporated in their entirety by reference herein. The '538 and '453 patents disclose a removable face plate for covering a skimmer opening during winter months. The cover element is made from a flexible plastic material which snaps onto a specially-configured skimmer face plate frame. The skimmer face plate frame has a raised or flanged peripheral edge onto which the cover element is snapped. The flow diverting weir of my above-mentioned '254 patent is adapted to be detachably secured to the peripheral edge of the skimmer face plate of the type disclosed in the '538 and '453 patents. The improved flow diverting weir of the present invention is, likewise, configured to be detachably attached to the skimmer face plate flanged peripheral edge of the '538 and '453 patents.

SUMMARY OF THE INVENTION

Briefly stated, my invention is directed to an improved flow diverting weir adapted to be attached to the face plate of a skimmer of a swimming pool. The skimmer includes a skimmer face plate mounted on the sidewall of the pool having a four-sided, frame-like shape with an opening therein to permit pool water to flow into an interior portion of the skimmer. The four-sided skimmer face plate carries flange means formed around a periphery thereof extending outwardly from the face plate. The face plate also carries a flat planar border area situated between the flange means and the opening in the face plate. The skimmer face plate is disclosed in the above-cited '538, '453 and '254 patents. The improved detachable weir of the present invention includes a scoop-like member enclosed on three sides and open on the fourth side to allow for the entry of water. The weir is attached at its lower periphery to a flat planar web portion which surrounds the bottom of the scoop-like shape. The outer peripheral edges of the planar portion carry a flexible lip means formed along the peripheral edge for snappable attachment to the flange means of the skimmer face plate around the four sides of the skimmer face plat. The flat planar web portion of the weir engages the flat border portion of the skimmer face plate when the weir is snapped in place. The open portion of the scoop-like cover element of the improved weir communicates with the interior of the skimmer body to permit pool water to flow therein.

The area of influence of the weir of the present invention is increased by the provision of a paddle-like extension. The scoop-like cover element has a detent slot formed in a top surface thereof to accept the narrow end of the elongated rectangularly-shaped paddle therein. The paddle is removably received in the slot opening of the cover element and extends outwardly into the pool to divert additional water into the open side of the scoop-like member and thence into the skimmer body for recirculation and cleaning. Since the paddle-like member extends into the pool some 15 inches, for example, it may at times be desirable to remove the paddle when the pool is in use. Likewise, because the scoop-like weir protrudes about 3 inches into the pool from the skimmer face plate, it may also be advisable to remove the weir itself from the skimmer when the pool is in use, particularly when children are using the pool. In addition, the weir is easily detached from the pool by unsnapping the sealing lip from the skimmer face plate flange. In this manner, the improved weir of the present invention may also be removed and rotated 180° and reattached to the skimmer face plate if the direction of the water flow in the pool is reversed for any reason. A pull tab is provided on a comer of the lip for convenience in removing the weir from the skimmer face plate.

DETAILED DESCRIPTION OF THE INVENTION

Figure 1:
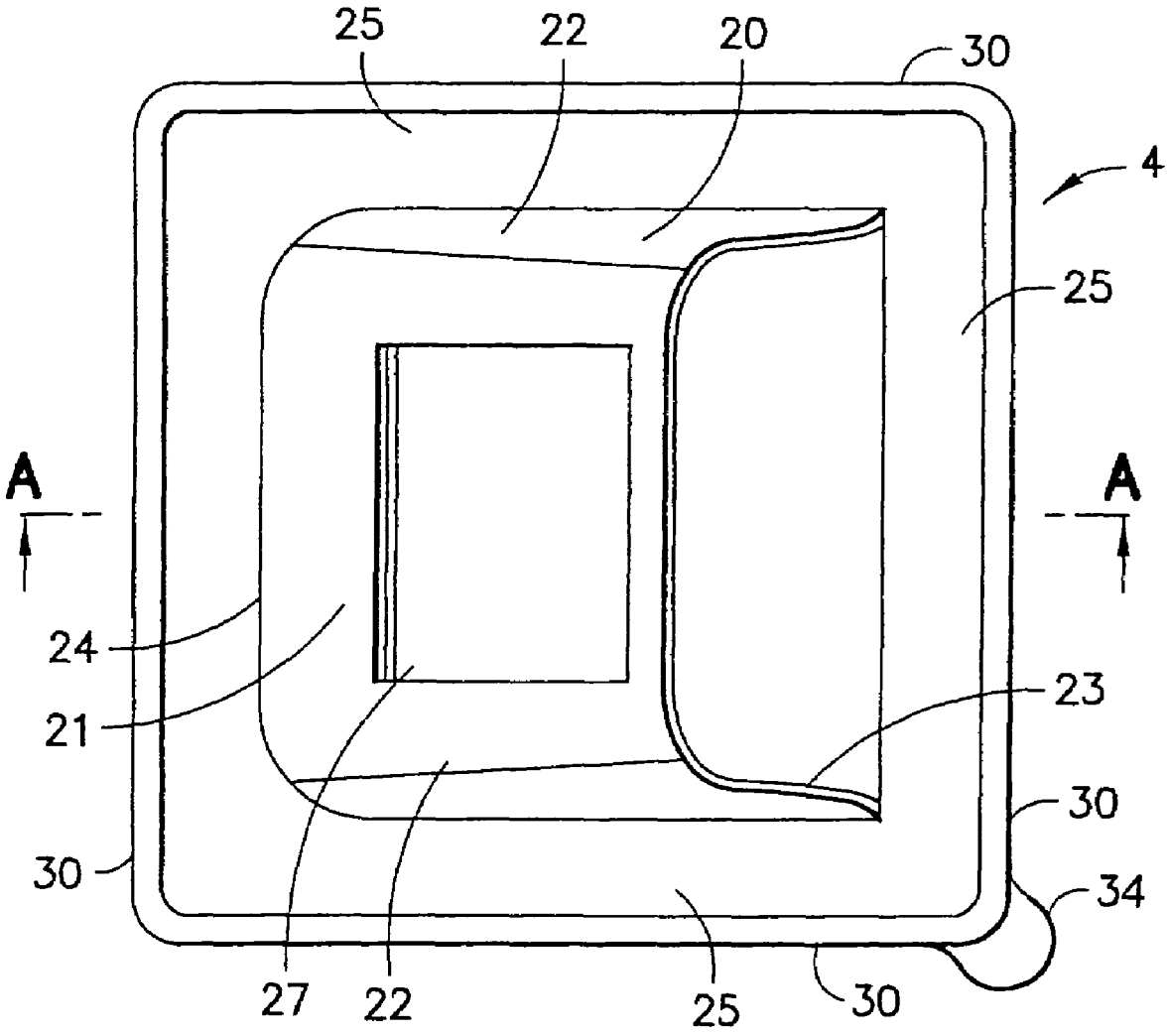
FIG. 1 is a top plan view of the improved weir of the present invention.
Figure 1A:
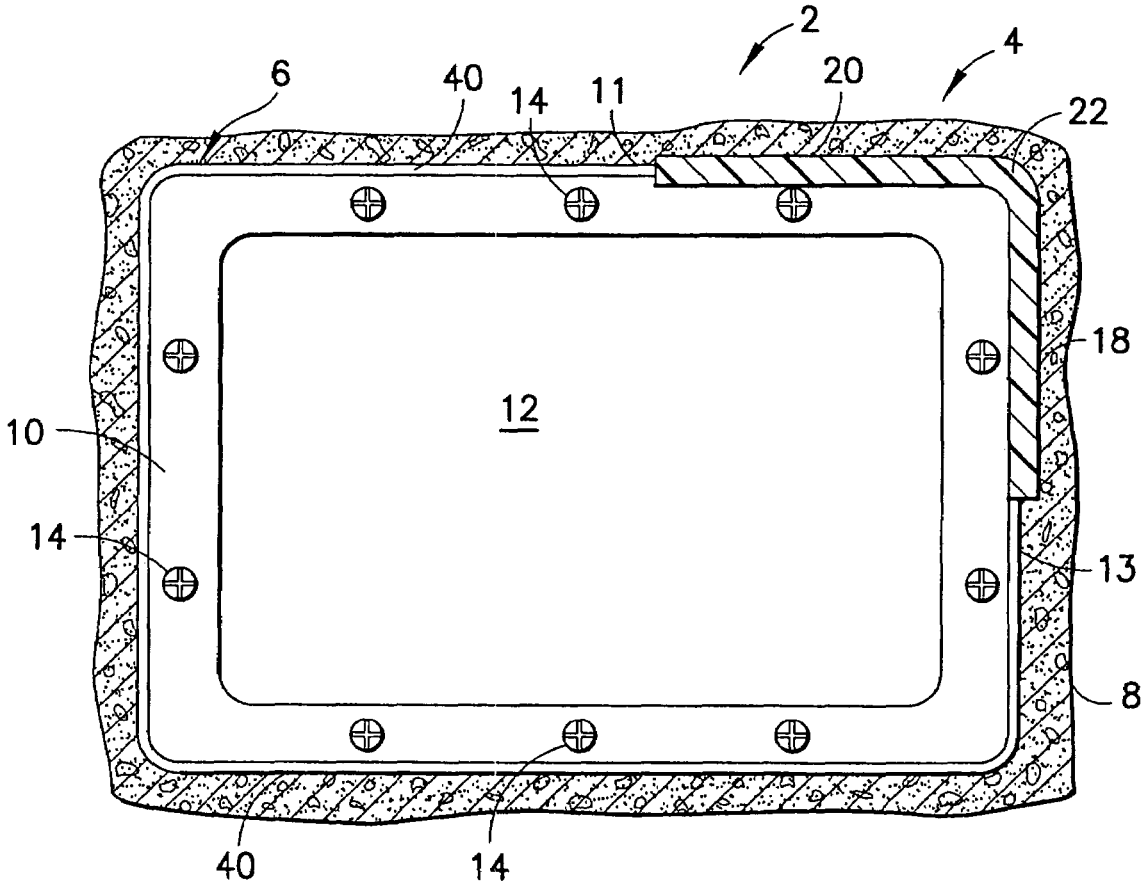
FIG. 1A is a front elevation view of a skimmer face plate to which the weir of the present invention is adapted to be attached.

Referring now to the drawings, a skimmer face plate, generally designated 2 in FIG. 1A, is shown in partial combination with the weir 4 of the present invention. The skimmer assembly 2 comprises a skimmer face plate 6 which is generally rectangular in shape and is, as mentioned above, preferably of the type disclosed in the '538 Hodak patent. The skimmer face plate 6 is attached to the sidewall 8 of a swimming pool in a conventional manner using a plurality of screws 14 to screw the face plate onto the sidewall and to a skimmer body (not shown) positioned on the outside of the sidewall 8 of the pool. The skimmer face plate has an opening 12 therethrough which allows for the flow of water into the skimmer assembly 2 for recirculation and filtering. The skimmer face plate 6 also carries an upwardly standing flange 40 around the outer periphery thereof which, in the referred-to '538 Hodak patent, accepts a flat plastic member for sealing off the skimmer opening 12 during the winter months. The improved weir 4 of the present invention carries a flexible lip 30 much like the sealing member of the '538 Hodak patent for snapping onto the upstanding flange 40 of the skimmer face plate 6. The skimmer face plate also includes a flat border portion 10 extending between the flange 40 and the opening 12 of the skimmer face plate 6.

Figure 4:
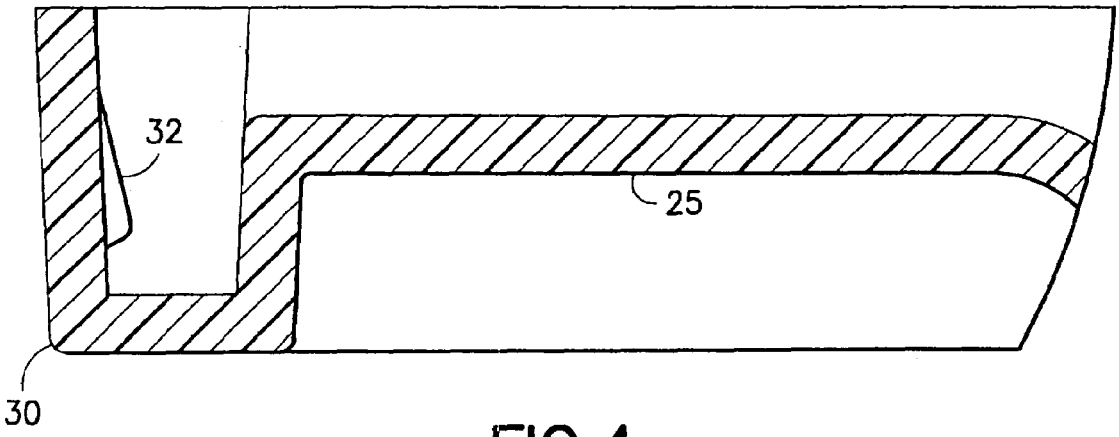
FIG. 4 is a partially fragmented, enlarged cross-sectional view of the sealable edge of the improved weir of the present invention.
Figure 3:
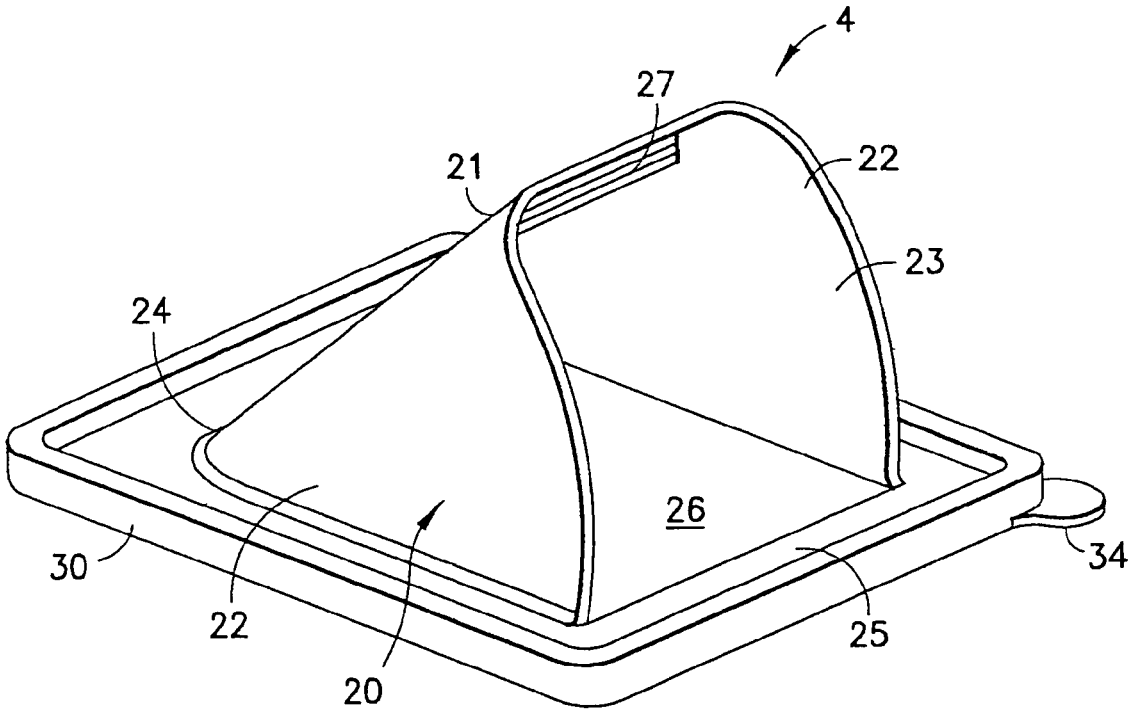
FIG. 3 is a perspective view of the flow diverting weir of the present invention.

The improved detachable weir for the present invention includes a scoop-like cover member 20 having an angular or slanted top 21 and enclosing sides 22 and an open front side 23 and open bottom 26 which permits the ingress of water into the weir 4 for passage into the opening 12 of the skimmer face plate and, hence, into the skimmer structure 2. A lower edge 24 of the slanted top 21 and the sides 22 are integral with a flat planar web portion 25 which, in turn, is integral with the peripheral lip 30. With reference to FIG. 4, the peripheral lip 30 is generally U-shaped in cross-section carrying a detent 32 which is adapted to snap against a similar notched detent in the flange 40 carried by the skimmer face plate 6. In the snapped-on condition, the planar web portion 25 lies flat against the border 10 of the face plate 6 for good stability and sealing. As best seen in FIG. 3, the open front end 23 of the scoop-like cover member 20 communicates with the opening 26 through the planar web portion 25 to permit direct communication with the opening 12 of the skimmer face plate 6. The peripheral lip 30 of the weir may also carry a pull tab 34 for easy grasping to permit removal of the weir 4 from the skimmer face plate 6.

Figure 2:
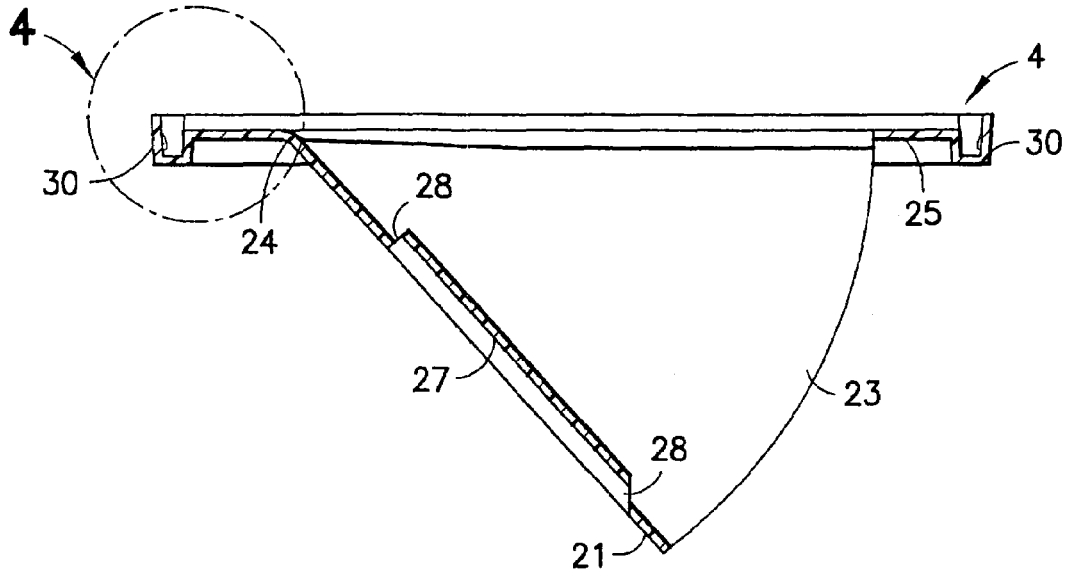
FIG. 2 is a cross-sectional view of the flow diverting weir of the present invention taken along section line A—A of FIG. 1.
Figure 6:
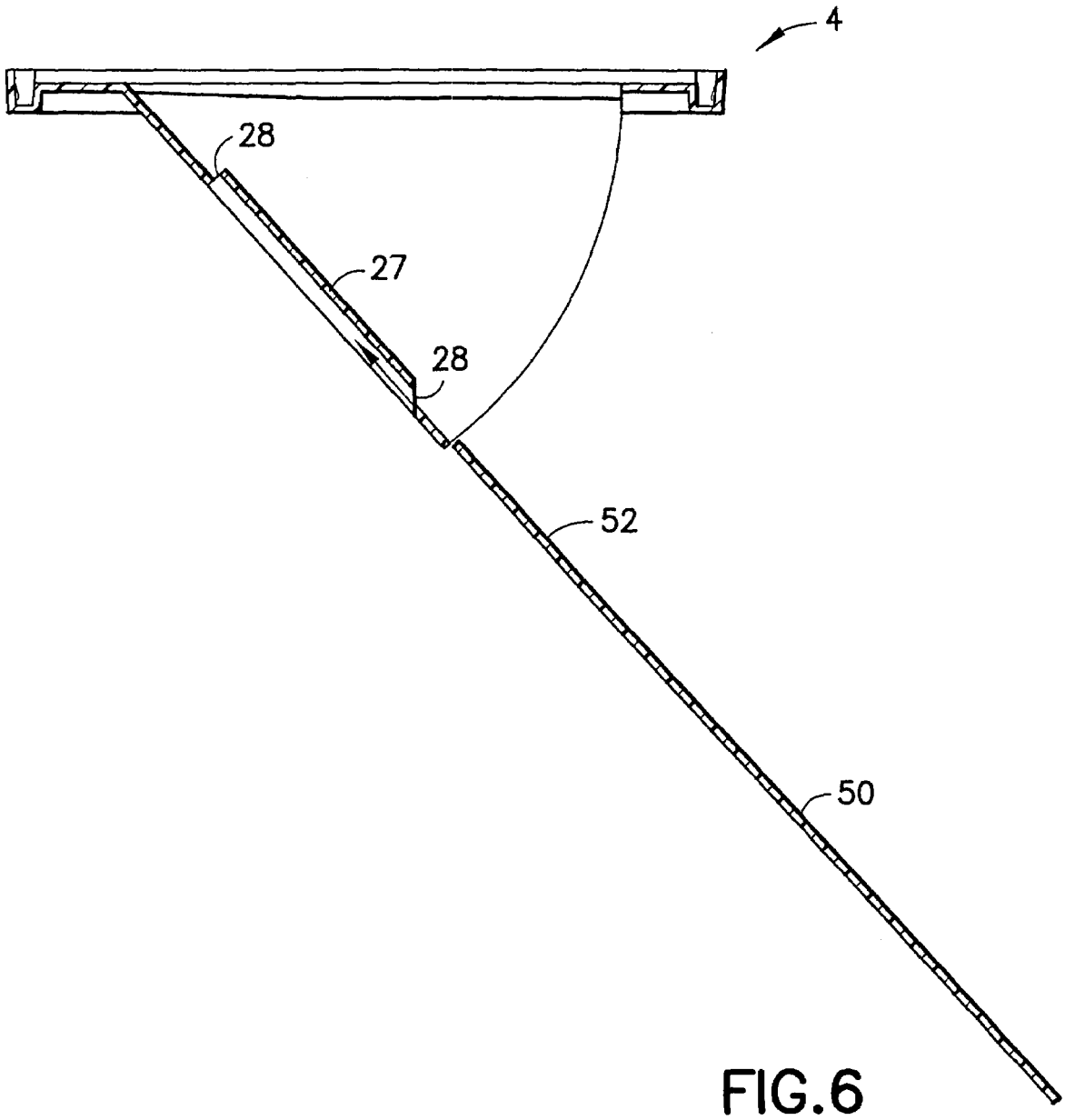
FIG. 6 is a sectional view taken along section line A—A of FIG. 5.

The plane defined by the slanted top surface 21 of the scoop-like cover member 20 is formed at an angle of about 47° relative to a plane passing through the flat planar web portion 25. A presently preferred dimension for the length of the top 21 is about 5.6 inches as measured from the bottom edge 24 to the terminal end at the apex. The top surface 21 of the scoop-like cover member 20 also carries a slotted indented portion 27 formed therein. As can be seen in FIG. 2 and FIG. 6, for example, the slotted portion is depressed inwardly from the outer plane of the surface 21 and has open slots 28 formed at either end to permit the insertion of a flow extension paddle 50 therein. The rectangular paddle 50 includes a narrower end 52 which has a width slightly smaller than the width of the slotted detent 27. The end 52 of the paddle 50 slidably fits through the slots 28 of the slotted portion 27 of the cover top surface 21. The paddle 50 may, thus, be removably fitted within the slotted portion 27 to extend outwardly from the scoop-like cover member 20 a distance into the pool. The paddle member 50 may have a length on the order of about 15 inches more or less when installed so as to affect a much greater area of influence for the skimmer. As the pool water circulates around the pool, the paddle member 50, due to its significant length, causes the pool water to divert and flow into the skimmer 2 for treatment.

Figure 5:
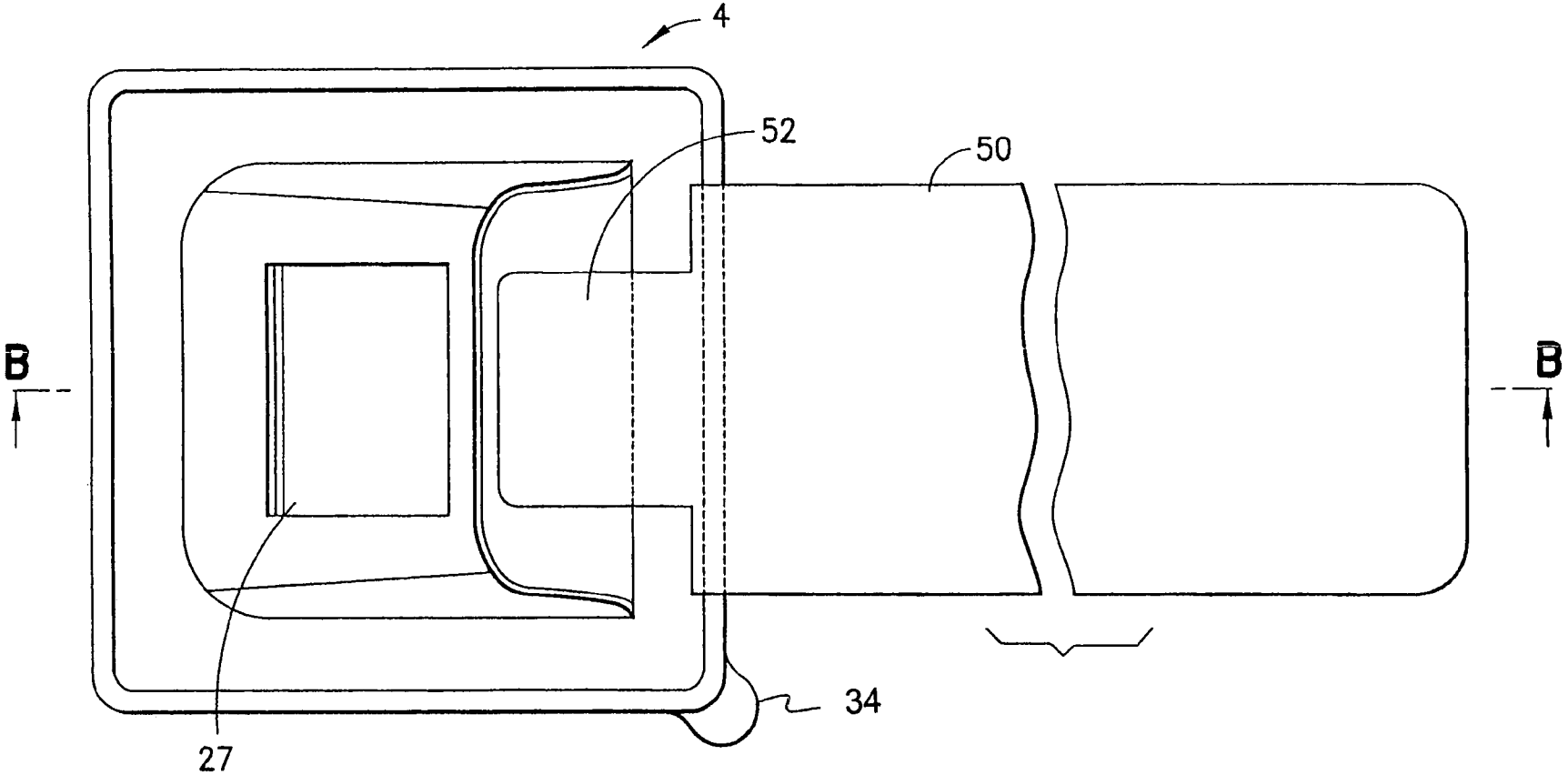
FIG. 5 is a top plan view of the improved weir of the present invention similar to FIG. 1 with the addition of an improved flow influence extender member of the present invention.

FIGS. 5 and 6 show the combination of the scoop-like cover member 20 and extension paddle 50. The narrowed portion 52 of the paddle member 50 may extend a distance of about 5 inches into the slotted portion 27 with the terminal end of portion 52 coming to rest near or against the lower edge 24 of the top member 21. The current of the pool tends to keep the extension paddle 50 and narrowed portion 52 firmly in place within the slotted detent 27. The paddle 50 may conveniently be removed when desired simply by pulling it out of the slotted detent 27. This may be desirable if the pool is to be used by swimmers, since the extended paddle 50 may interfere with free use of the pool and may present a hazard to swimmers. Likewise, the scoop-like cover member 20 and weir 4 may be completely removed from the skimmer face plate, if desired. Conversely, if the current in the pool is reversed, the weir 4 may be rotated 180° simply by removing it from the weir and reorienting it in the desired direction when such a change in flow occurs.

The weir 4 and the paddle 50 are preferably made of thermoplastic materials which are flexible, such as polyvinyl chloride, nylon, polypropylene or the like.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A flow diverting weir for attachment to a face plate of a skimmer of a swimming pool comprising an enclosed scoop member having an opening on one side to allow entry of water from the pool into the skimmer, the scoop member further includes a lower peripheral edge which carries flexible lip means for attachment to an upstanding peripheral flange carried by the skimmer face plate, the scoop member further includes a surface carrying slot means and an elongated paddle removably received in the slot means, said paddle adapted to extend outwardly into the pool to divert an additional surface flow of pool water into the scoop member and skimmer.

2. In combination, a face plate for a swimming pool skimmer and a flow diverting weir for attachment to the face plate, said skimmer face plate comprising a rectangularly shaped frame-like structure adapted to be affixed to a swimming pool sidewall surrounding a skimmer opening therein; said face plate carrying an upstanding flange around an outer periphery thereof, and said flow diverting weir comprising an enclosed scoop member having an opening on one side to allow entry of water from the pool into the skimmer opening, the scoop member further includes a lower peripheral edge which carries flexible lip means for attachment to the flange of the skimmer face plate, the scoop member further includes a surface carrying slot means and an elongated paddle removably received in the slot means, said paddle adapted to extend outwardly into the pool to divert an additional surface flow of pool water into the scoop member and skimmer opening.

* * * * *